United States Patent [19]

Paterson

[11] 4,313,543

[45] Feb. 2, 1982

[54] MULTI-SIZE MATERIALS SEPARATOR

[75] Inventor: Malcolm M. Paterson, Lee, N.H.

[73] Assignee: Raytheon Company, Lexington, Mass.

[21] Appl. No.: 228,481

[22] Filed: Jan. 26, 1981

Related U.S. Application Data

[63] Continuation of Ser. No. 71,817, Sep. 4, 1979, abandoned.

[51] Int. Cl.[3] ..... B03C 1/08; B03C 1/12

[52] U.S. Cl. ..... 209/212; 209/220; 209/223 R

[58] Field of Search ..... 209/212–214, 209/219, 220, 223 R, 223 A, 227, 231, 444, 459, 472, 480, 478, 143

[56] References Cited

U.S. PATENT DOCUMENTS

| | | | |
|---|---|---|---|
| 400,317 | 3/1889 | Edison | 209/212 |
| 2,272,719 | 2/1942 | Maynard | 209/219 |
| 3,181,637 | 5/1965 | Cockerell | 209/143 X |
| 3,448,857 | 6/1969 | Benson et al. | 209/212 |
| 3,824,516 | 7/1974 | Benowitz | 209/212 X |
| 4,003,830 | 1/1977 | Schloemann | 209/3 |

FOREIGN PATENT DOCUMENTS

| | | | |
|---|---|---|---|
| 2059166 | 6/1972 | Fed. Rep. of Germany | 209/223 |
| 46-4244 | 2/1971 | Japan | 209/220 |
| 21276 | of 1900 | United Kingdom | 209/220 |
| 1317736 | 5/1973 | United Kingdom . | |
| 1324126 | 7/1973 | United Kingdom . | |

*Primary Examiner*—Ralph J. Hill

*Attorney, Agent, or Firm*—John T. Meaney; Joseph D. Pannone; Richard M. Sharkansky

[57] ABSTRACT

Materials separator apparatus for segregating electrically conductive particles having a wide range of sizes from a stream of commingled materials. The apparatus includes a material feeder device disposed for directing the commingled particles into a stream. A spatially alternating, steady-state array of juxtaposed, oppositely directed magnetic fields of varying widths is established adjacent the stream. As the materials pass through the magnetic fields, forces exerted on the electrically conductive particles cause lateral deflection of these particles from the stream thereby providing the desired separation. Because the widths of the magnetic fields vary over a wide range, the apparatus provides effective separation of a wide range of sizes of electrically conductive particles.

28 Claims, 16 Drawing Figures

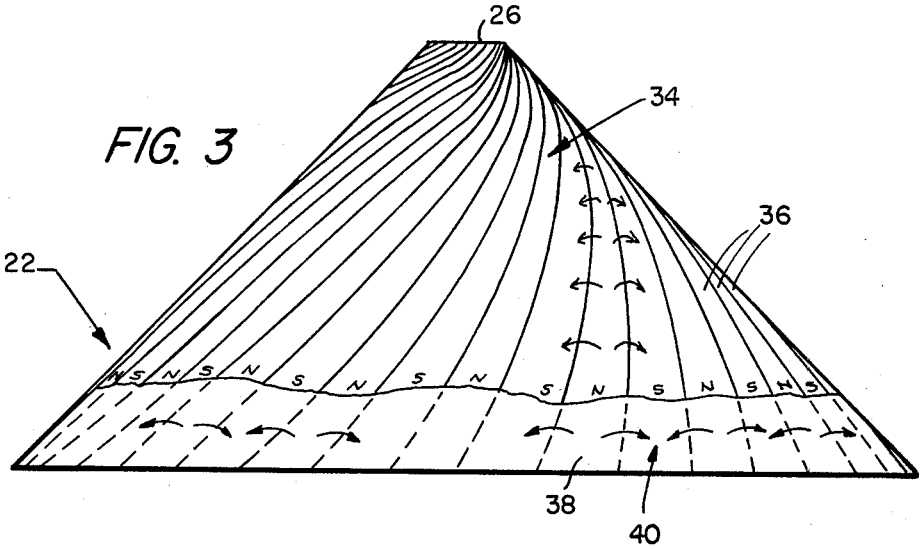
FIG. 3
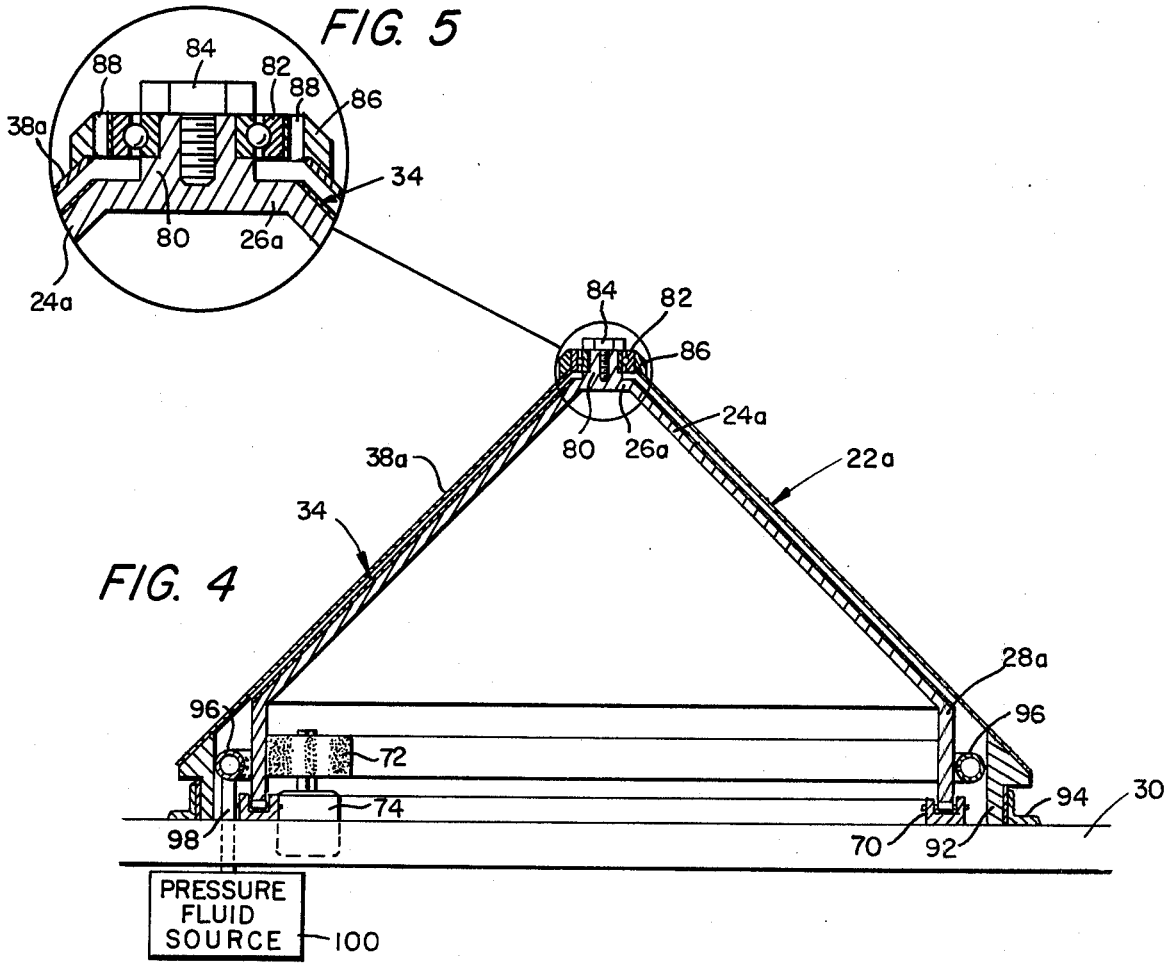
FIG. 5
FIG. 4

FIG. 12
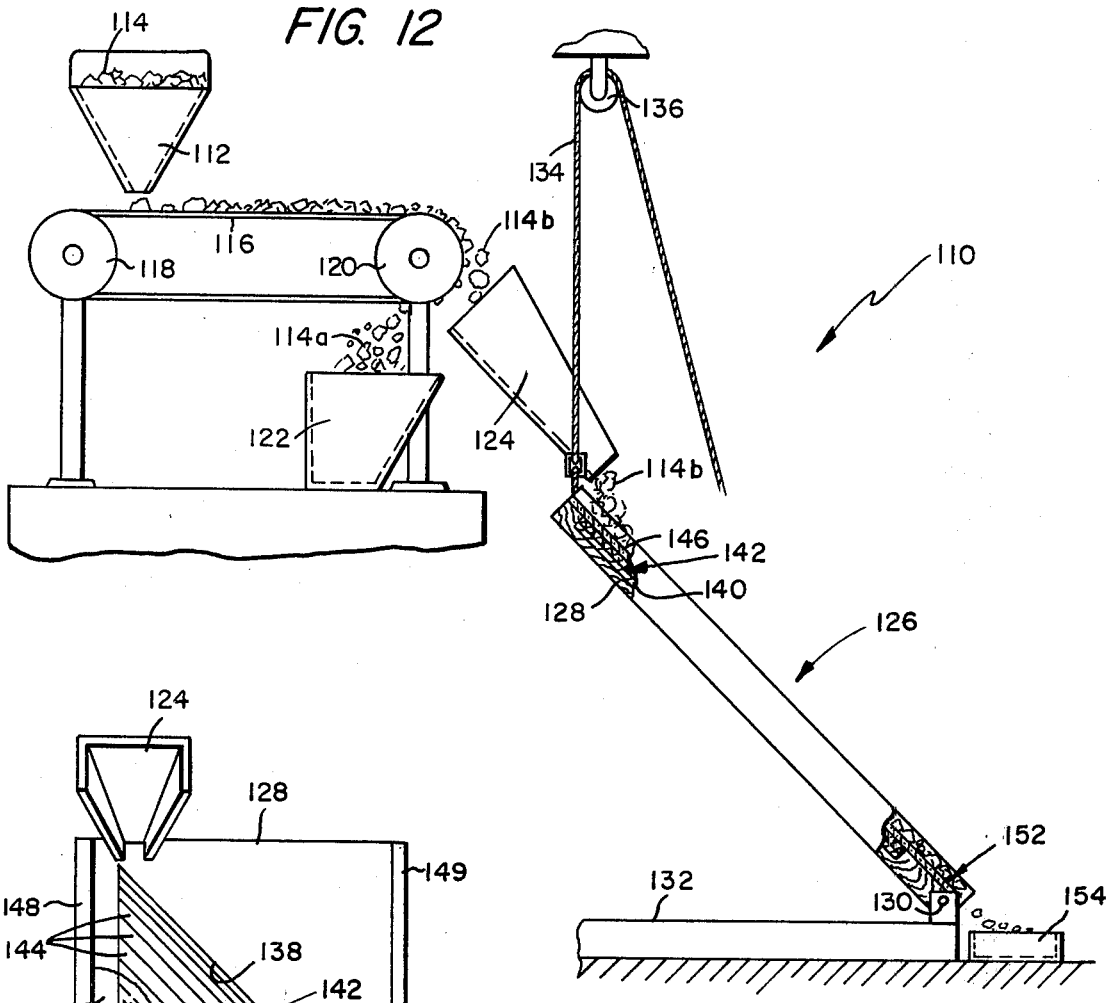
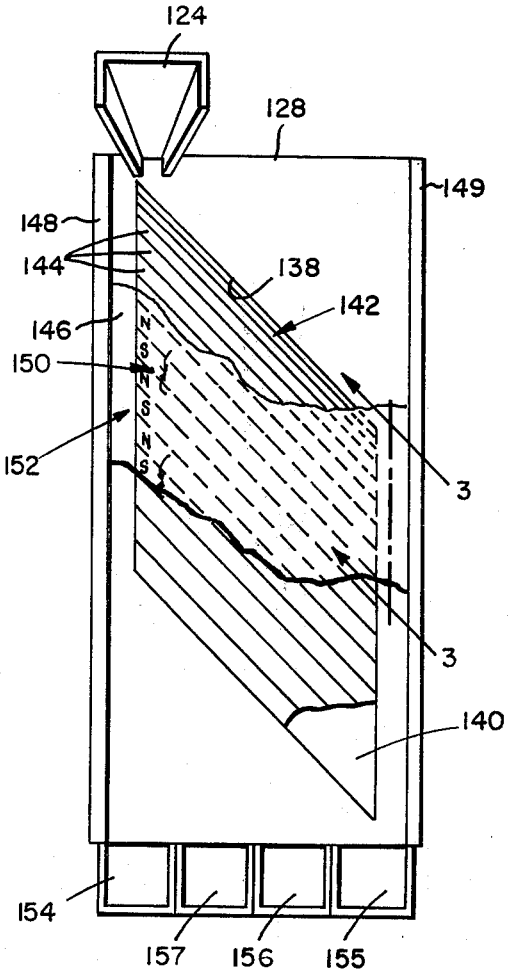
FIG. 13
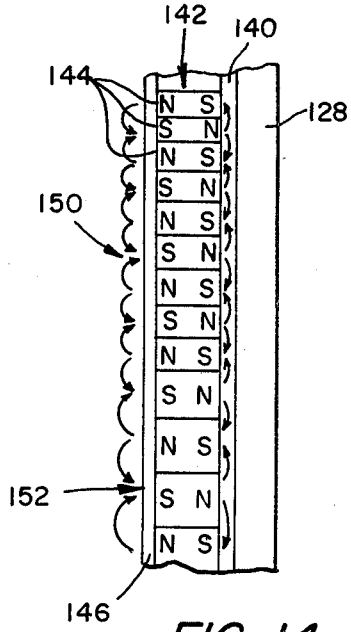
FIG. 14

MULTI-SIZE MATERIALS SEPARATOR

Cross-Reference to Related Cases

This is a continuation of application Ser. No. 71,817, filed Sept. 4, 1979, now abandoned.

BACKGROUND OF THE INVENTION

1. Field of the Invention

This invention relates generally to materials separator apparatus and is concerned more particularly with a materials separator having varying width magnetic means for segregating electrically conductive particles of various sizes from a stream of commingled materials.

2. Discussion of the Prior Art

In the recycling of waste material, solid municipal waste initially may be shredded by conventional means, such as a hammer mill, for example, which generally reduces the waste material to more manageable particles of non-uniform size. After shredding, the non-uniform size particles may be conducted to a conventional air classifier wherein the particles of light fraction material, such as paper, for example, are separated from the particles of heavy fraction material. The heavy fraction particles then may be conveyed in a stream, as by an endless belt, for example, to a magnetic separator of the conventional type which separates particles of ferromagnetic or highly magnetic material, such as iron, for example, from the stream. Thus, the stream emerging from the magnetic separator is substantially comprised of heavy fraction particles of nonferromagnetic material including dielectric material, such as glass, rubber, and plastic, for examples, and electrically conductive material, such as aluminum, silver, copper, zinc, and the like. Since the electrically conductive particles of nonferromagnetic material constitute a significant percentage of the value of recycled waste material, material separators of the prior art have been developed for segregating the electrically conductive particles of nonferromagnetic material from the stream of commingled materials.

For example, U.S. Pat. No. 4,003,830 granted to E. Schloemann and assigned to the assignee of this invention discloses a materials separator comprising a ramp having a low friction, sloped surface down which the particles of non-ferromagnetic material slide in a stream due to the force of gravity acting on the particles. The sloped surface of the ramp is made of non-magnetic material and overlies an alternating series of oppositely polarized magnets having respective magnetic poles of substantially uniform width disposed adjacent the sloped surface of the ramp. The magnetic poles are disposed substantially parallel to one another and extend transversely at a uniform oblique angle to the longitudinal centerline of the sloped surface. Consequently, there is established above the sloped surface a spatially alternating, steady-state array of juxtaposed, oppositely directed magnetic fields having substantially uniform widths. The fields also are disposed substantially parallel to one another and extend transversely at a uniform oblique angle to the longitudinal centerline of the sloped surface.

Thus, particles in the stream sliding down the sloped surface of the ramp pass sequentially through oppositely directed fields of the spatially alternating array established by the underlying magnets. The dielectric particles of non-ferromagnetic material in the stream are substantially unaffected by the magnetic fields and continue to travel generally linear paths down the sloped surface due to the force of gravity. However, the electrically conductive particles of nonferromagnetic material, when passing sequentially through the oppositely directed fields of the array, have respective eddy-currents induced therein. These eddy-currents coact with the magnetic fields to exert on the electrically conductive particles respective resultant forces having deflecting components which move the particles laterally out of the stream, in a uniform direction, while they are sliding longitudinally down the sloped surface of the ramp. As a result, the electrically conductive particles of nonferromagnetic material separate angularly from the stream of commingled materials and may be collected in suitably disposed containers at the lower end of the sloped surface.

While the described apparatus has been found satisfactory for separating a wide range of electrically conductive particle sizes, it is sometimes desirable to separate a still wider range of electrically conductive particle sizes from the stream, particularly particles of extremely small size.

SUMMARY OF THE INVENTION

Accordingly, this invention provides a materials separator apparatus having magnetic means disposed for establishing a spatially alternating array of juxtaposed, oppositely directed magnetic fields of varying widths, and control means for directing commingled particles of various materials and sizes into a stream and producing relative movement of the particles sequentially through the magnetic fields. Thus, the control means may include a sloped surface overlying the magnetic means and down which the commingled particles slide in a stream, and may include rotatable means, such as a motor, for example, which moves the magnetic means relative to the stream of commingled particles or vice versa.

The invention also relates to a method for separating material comprising the steps of directing commingled particles into a stream; providing a spatially alternating array of juxtaposed oppositely directed magnetic fields of various widths adjacent the stream; and producing relative movement of the particles through the magnetic fields.

In a preferred embodiment, the magnetic means may comprise a generally conical array of juxtaposed, oppositely polarized magnets having respective tapering widths disposed such that minimum widths are adjacent the upper end of the conical array and maximum widths are adjacent the lower end thereof. The control means may include a conical shaped layer of nonmagnetic material overlying the conical array of magnets and having a smooth upper surface down which the commingled particles slide in a stream. Consequently, the magnets may have respective scythe-like configurations and extend transversely at an oblique angle to the stream. Also, the control means may include means for rotating the outer layer relative to the underlying array of magnets or vice versa to produce relative movement of the particles through the magnetic fields. Alternatively, the magnets may have respective wedge-shaped configurations extend linearly along the sloped height of the conical array. In this alternative embodiment, the control means includes energy means for rotating the outer layer relative to the underlying array of magnets or vice versa.

In another alternative embodiment, the control means may comprise a sloped, ramp-type surface overlying the magnetic means which is comprised of juxtaposed, oppositely polarized magnets extended transversely at a uniform oblique angle to the longitudinal centerline of the sloped surface. Each of the magnets may have a respective width which is uniform from widths of end-to-end of the magnet but differs with respect to widths of other magnets of the array.

BRIEF DESCRIPTION OF THE DRAWINGS

For a better understanding of this invention, reference is made in the following detailed description to the drawings wherein:

FIG. 3 is an elevational view, partly in section, of a portion of the materials separator shown in FIG. 1;

FIG. 4 is an axial sectional view of an alternative embodiment of the invention;

FIG. 5 is an enlarged fragmentary view of the upper end portion of the apparatus shown in FIG. 4;

FIG. 11 is a fragmentary axial view illustrating another alternative rotation means for the embodiments shown in FIGS. 4 and 7;

FIG. 12 is a schematic elevational view of another materials separator apparatus embodying the invention;

FIG. 13 is a fragmentary plan view, partly in section, of the material apparatus shown in FIG. 12;

FIG. 14 is a fragmentary axial view of the materials separator shown in FIGS. 12 and 13;

DESCRIPTION OF THE PREFERRED EMBODIMENTS

Figure 1:
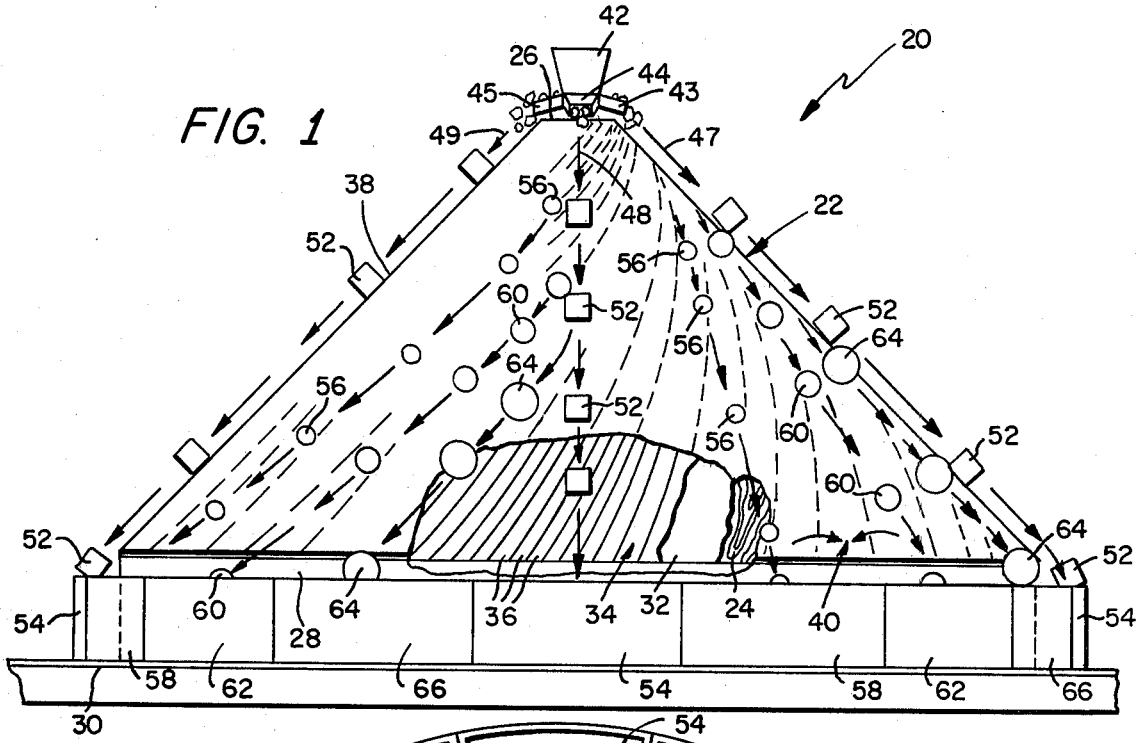
FIG. 1 is an elevational view, partly in section, of materials separator apparatus embodying the invention.
Figure 2:
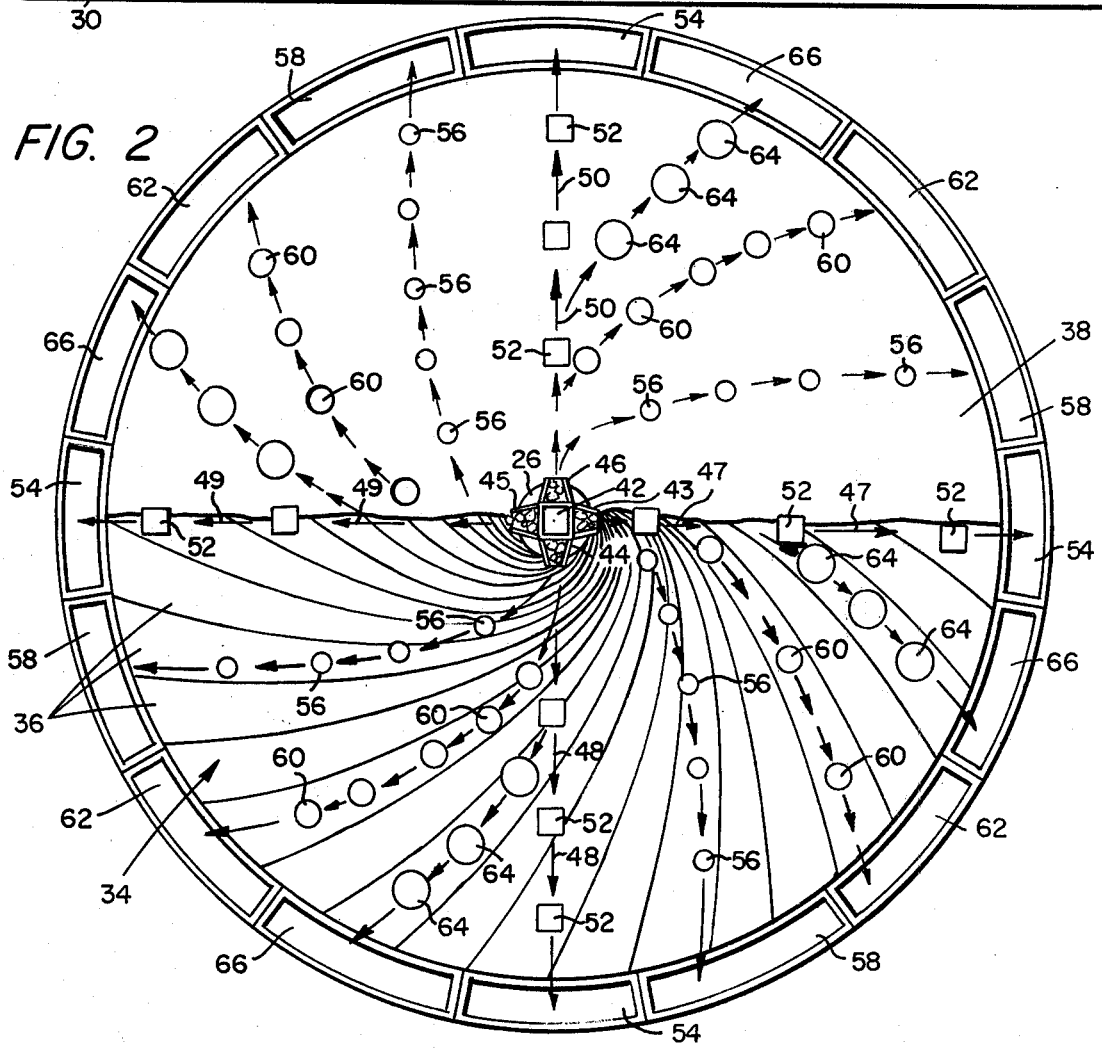
FIG. 2 is a plan view, partly in section, of the materials separator apparatus shown in FIG. 1.

Referring to the drawings wherein like characters of reference designate like parts, there is shown in FIGS. 1–3 materials separator apparatus 20 comprising a materials separator 22 which preferably has a generally conical configuration. The separator 22 may include an inner frusto-conical support member 24 made of rigid nonmagnetic material, such as wood, for example. Support member 24 preferably is hollow and has an apex or a truncated upper end portion terminating in a small diameter end surface 26. An opposing, larger diameter end portion of support member 24 may terminate in an axially extending, annular skirt 28 which rests on and may be suitably secured to an underlying floor or stationary platform 30. The sloped outer surface of support member 24 is covered with a thin cladding or layer 32 of low magnetic reluctance material, such as mild steel, for example. Thus, the support member 24, alternatively, may be made of rigid, low magnetic reluctance material, such as mild steel, for example, and not require the covering layer 32 on its sloped outer surface.

Supported on the layer 32 is a magnetic means comprising frusto-conical array 34 of steady-state magnets 36 having respective tapering widths laid side-by-side about the sloped surface portion of support member 22. Accordingly, the magnets 36 have respective maximum width end portions disposed annularly in juxtaposed relationship adjacent the skirt 28, and respective minimum width end portions disposed annularly in juxtaposed relationship adjacent the end surface 26. It is preferred that any spacing between adjacent magnets 36 of array 34 be small in comparison to the respective width dimensions of the adjacent magnets. Consequently, in view of their minimal width dimensions adjacent end surface 26, the magnets 36 preferably are disposed in substantially contiguous relationship with adjacent magnets in the array 34. Also, the magnets 36 may be provided with respective scythe-like configurations for interfitting with adjacent magnets to form a spiralling array 34 wherein each of the magnets 36 extends transversely at a uniform oblique angle with the slant height of the array 34 and support member 22.

The magnets 36 may be cut or stamped from suitable magnet strip material, such as Flexible Permanent Magnetic Strip sold by Bunting Magnetics Company of Illinois, for example, which comprises a flexible binder, such as rubber-base material, for example, impregnated with a permanent magnet material, such as barium ferrite or samarium colbalt, for examples. The magnet strip material may be provided with an adhesive backing, if desired, for securing the respective magnets 36 of array 34 in position on the layer 32. Alternatively, the magnets 36 may be held in position on layer 32 by their magnetic attraction to the low reluctance material of layer 32. Thus, the scythe-like strip magnets may be laid in spiralling, juxtaposed relationship on the sloped outer surface of layer 32 to extend transversely at an oblique angle to the slant height of frusto-conical separator 22.

Each magnet 36 of array 34 is magnetized through its respective thickness to have its entire lower surface adjacent layer 32 constituting one magnetic pole and its entire opposing upper surface constituting the opposite magnetic pole. Also, adjacent magnets 36 of the spiralling array 34 are oppositely magnetized through their respective thicknesses to provide adjacent the opposing surfaces of array 34 respective alternating series of north and south magnetic poles. Each pole of the alternating series adjacent layer 32 is magnetically coupled to the juxtaposed magnetic poles on either side thereof by respective oppositely directed fields of magnetic flux extended through the low reluctance material of layer 32. Also, each pole of the alternating series adjacent the outer surface of array 34 is magnetically linked to the juxtaposed magnetic poles on either side thereof by respective oppositely directed fields of magnetic flux lines extending arcuately above the sloped outer surface of array 34.

Overlying the array 34 of magnets 36 is a control means comprising frusto-conical layer 38 of substantially smooth, nonmagnetic material, such as austenitic steel, for example, having a sloped outer surface down which particles of commingled nonferromagnetic materials may slide due to the force of gravity acting on the particles. Layer 38 preferably is made as thin as possible and adheres closely, as by bonding, for example, to the outer surface of array 34 so that the arcuate flux lines linking opposite magnetic poles of adjacent magnets 36 extend well above the layer 38. Thus, there is established above the sloped outer surface of layer 38 a spatially alternating array 40 of oppositely directed steady-state magnetic fields. Each of the fields of array 40 extends transversely at an oblique angle to the slant height of separator 22, and has a uniformly varying width which tapers from a maximum value adjacent the skirt 28 to a minimum value adjacent the end surface 26.

The materials separator apparatus 10 also is provided with additional control means which may include material feed means, such as funnel-shaped hopper 42, for example, disposed for receiving therein commingled particles of substantially nonferromagnetic materials and directing them into an output stream. Hopper 42 is suitably supported over the end surface 26 of separator 22 for feeding output streams of the commingled particles to other portions of the control means comprising a plurality of guide means, such as respective vibrating chutes or trays 43, 44, 45, and 46, for examples. Each of the chutes 43–46 may be associated with a respective quadrant of separator 22 and is disposed for directing its respective stream of commingled particles, in cooperation with the force of gravity, down the aligned sloped portion of smooth-surfaced layer 38. Thus, streams 47, 48, 49 and 50, respectively, of commingled particles egressing from the chutes 43–46 are directed along respective sloped paths, each of which conforms substantially to the slant height of frusto-conical separator 22. As a result, the spatially alternating, oppositely directed magnetic fields of array 40, which are transversely disposed at an oblique angle to the slant height of separator 22, are similarly disposed at an oblique angle with respect to the streams of commingled particles egressing from the chutes 43–46, respectively.

The particles of nonferromagnetic materials sliding down the sloped surface of layer 38 pass sequentially through the respective magnetic fields of array 30. Dielectric particles 52 of nonferromagnetic materials, such as rubber, plastic, and the like, are unaffected by the magnetic fields and follow substantially linear paths indicated generally by respective arrows 47–50 aligned with the chutes 43–46. Thus, suitable conveying means, such as respective containers 54, for example, may be positioned adjacent the skirt 28 and aligned with the chutes 43–46 for receiving dielectric particles 52 from the streams egressing therefrom.

On the other hand, electrically conductive particles of nonferromagnetic materials, such as aluminum, copper, and the like, have induced therein respective eddy-currents which coact with the magnetic fields to exert laterally deflecting forces on these particles. As a result, the electrically conductive particles, while travelling down the sloped surface of layer 38, diverge angularly out of the respective streams 47–50 egressing from chutes 43–46. Since the lateral deflecting force acting on an electrically conductive particle varies in accordance with the induced eddy-currents, the deflecting force attains maximal values periodically when the particle passes through regions of greatest magnetic flux change, which occur in portions of array 40 over adjacent sides of magnets 36 in array 34. Thus, an electrically conductive particle having an optimal size approximating the width dimension of underlying magnets 36 undergoes successive maximal lateral deflections in a uniform direction for moving the particle out of its respective stream.

Consequently, relatively small size, electrically conductive particles 56 in the respective streams 47–50 egressing from chutes 43–46 may have optimal dimensions for undergoing maximum lateral deflection on the small diameter end portion of separator 22, where the underlying magnets 36 taper to minimum width dimensions. When deflected, the relatively small size particles 56 pass through increasingly wider magnetic fields which provide correspondingly less than the maximal deflection effect provided by the optimal width magnetic fields adjacent the smaller diameter end of array 34. Thus, the relatively small size particles 56 continue to travel down the sloped surface of layer 38 along paths which diverge angularly from the respective streams 47–50 egressing from chutes 43–46. Accordingly, suitable conveying means, such as respective containers 58, for example, may be positioned adjacent skirt 28 and aligned generally with the paths of particles 56 for receiving these particles separated from their respective streams in the upper end portion of separator 12.

Similarly, intermediate size, electrically conductive particles 60 in the respective streams 47–50 undergo maximal lateral deflection on the midportion of separator 22 and follow respective paths which diverge angularly from the streams. Thus, suitable conveying means, such as respective containers 64, for example, may be positioned adjacent skirt 28 and aligned with the paths of particles 60 for receiving these particles separated from the respective streams on the mid-portion of separator 22. Also, relatively large size, electrically conductive particles 64 in the respective streams 47–50 may have optimal dimensions for undergoing maximum lateral deflection on the large diameter end portion of separator 22, where the underlying magnets 36 taper to maximum width dimensions. When deflected, the relatively large size particles 64 follow respective paths which diverge angularly from the streams. Thus, suitable conveying means, such as respective containers 66, for example, may be positioned adjacent skirt 28 and aligned with the paths of particles 64 for receiving these particles separated from the respective streams on the lower end portion of separator 22.

Accordingly, substantially all electrically conductive particles of nonferromagnetic materials having respective sizes between the minimum and maximum width dimensions of tapering magnets 36 will be of optimal size somewhere on the sloped surface of layer 38 for undergoing maximum lateral deflection from a stream of commingled particles. Also, electrically conductive particles of nonferromagnetic materials having respective sizes less than the minimum width dimensions of magnets 36 or greater than the maximum width dimensions thereof still may be laterally deflected less than the maximum distance from a stream of commingled particles. Thus, the frusto-conical separator 22 having tapering width magnets 36 is enabled to separate an extremely wide range of particle sizes.

Figure 6:
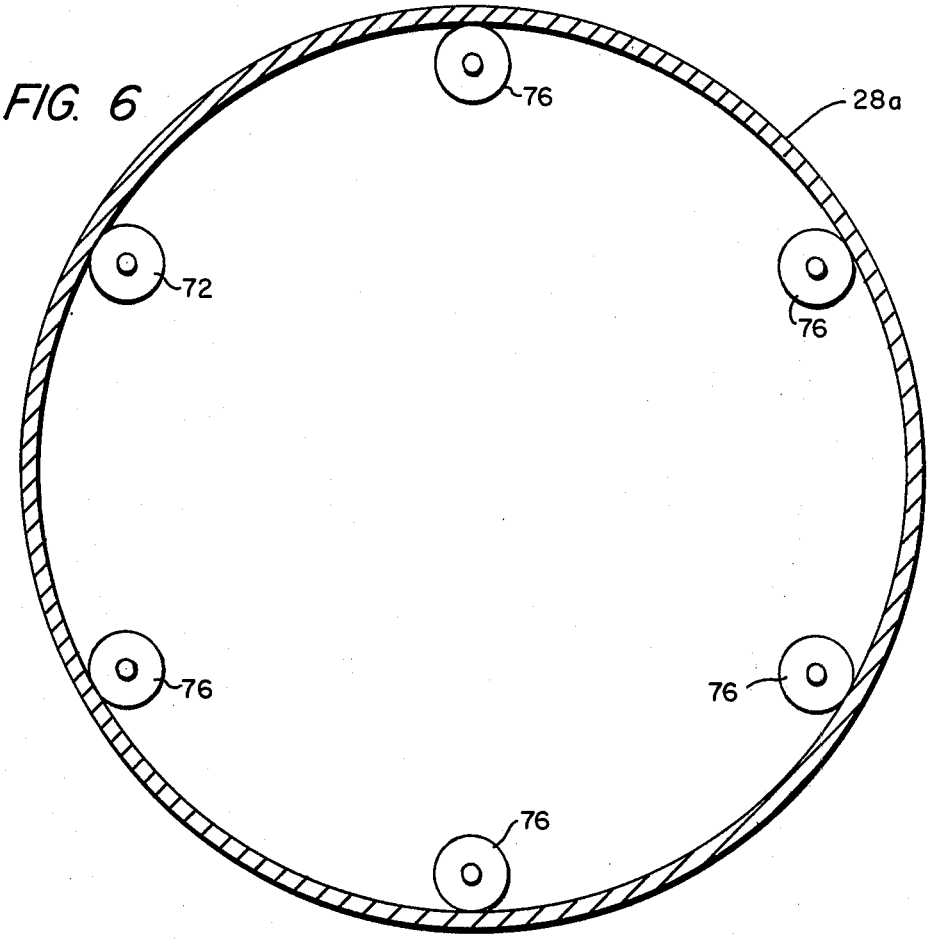
FIG. 6 is a transverse view, partly in section, of the inner frusto-conical member shown in FIG. 4.

Alternatively, as shown in FIGS. 4–6, the materials separator apparatus 20 may include a frusto-conical separator **22*a* which is similar to the materials separator 22 shown in FIGS. 1–3, except it includes control means for rotating the array 34 of magnets 36 relative to the streams of commingled materials. The separator 22*a* includes an inner frusto-conical support member 24*a* which preferably is hollow and made of suitable rigid, low reluctance material, such as mild steel, for example. Support member 24*a* has a large diameter end portion terminating in an annular skirt 28***a* having a circular rim rotatably mounted in a sealed circular bearing 70, which may be of the transverse roller type, for example. The inner surface of skirt 28*a* is frictionally engaged by a drive roller 72 which is rotated by suitable drive means, such as aligned electrical motor 74 mounted on stationary platform 30 underlying the separator 22*a*, for example. Also frictionally engaging the inner surface of skirt 28*a* is an annular array of spaced idler rollers 76 which counteract the radial pressure exerted by drive roller 72 and aid in rotating the support member 24*a* about its axial centerline.

Disposed on the outer sloped surface of support member 24*a* is the frusto-conical array 34 of juxtaposed spiralling magnets 36 shown in FIGS. 1–3. At the upper end portion of separator 22*a*, the hollow support member 24*a* is closed by a transverse wall 26*a* having extending axially upward from its central portion a stepped cylindrical post 80 which is encircled by a roller bearing 82. The inner portion of roller bearing 82 may be press-fitted over the post 80 and retained in place by suitable means, such as the hex-head of a bolt 84 journalled into the terminal end surface of post 80, for example. Secured to the outer portion of bearing 82 is an encircling flange 36 which preferably has extended through it a plurality of apertures 88. An outer peripheral portion of flange 86 is attached to a small diameter end portion of an outer frusto-conical member 38*a* which is similar in function to the outer layer 38 of separator 22 shown in FIGS. 1 and 2. The outer member 38*a* is made of suitable rigid, nonmagnetic dielectric material, such as fiberglass reinforced plenolic, for example, and has a smooth outer surface down which commingled particles of nonferromagnetic materials may slide with a minimum of friction.

However, in this embodiment, the large diameter end portion of outer member 38*a* extends beyond the array 34 of magnets 36 and terminates in an axially extending, annular wall 92 which may be secured to platform 30 by suitable means, such as an interconnecting annular angle bracket 94, for example. The wall 92 is radially spaced from the skirt 28*a*; and disposed annularly therebetween is an apertured distributor pipe 96 which is connected, as by conduit 98, for example, to a source 100 of pressurized fluid, such as air, for example. The source 100 preferably is secured by conventional means to the stationary platform 30 and supplies air, under pressure, to the pipe 96 from which the air passes between outer member 38*a* and array 34 of magnets 36 to exit through the apertures 88. Thus, the outer member 38*a* is spaced by a thin film of air from the magnets 36 of array 34 sufficiently to permit relative rotation of the array 34 by the support member 24*a*. However, the outer member 38*a* still is sufficiently close to array 34 of magnets 36 that the resulting array 40 of magnetic fields extends well above the outer surface of member 38*a*.

In operation, the source 100 may be activated to provide a thin film of air between the array 34 and the outer frustoconical member 38*a*. The motor 74 then may be energized to rotate the inner support member 14*a* and the array 34 of magnets 36 in a particular rotational direction, such as clockwise as viewed in FIG. 2, for example. A material feed means, such as hopper 42, for example, may be supported over the upper end portion of separator 22*a*, and be provided with a plurality of output chutes, such as 43–46, for example for directing respective streams of commingled, nonferromagnetic particles down aligned sloped portions of outer member 38*a*. As described for the embodiment shown in FIGS. 1–3, the commingled particles sliding down the outer member 38*a* pass sequentially through the spatially alternating fields of array 40 established above the outer sloped surface of member 38*a*. As a result, the electrically conductive particles of nonferromagnetic materials have induced therein eddy-currents which coact with the magnetic fields to exert lateral deflection forces on the particles.

However, since the magnets 36 of array 34 are rotating in the described clockwise direction, the magnetic fields of array 40 also are rotating in the clockwise direction above the outer member 38*a*. Consequently, to electrically conductive particles on the sloped outer surface of member 38*a*, the juxtaposed spiralling fields of array 40 appear to be travelling upward and clockwise, as viewed in FIG. 3. In accordance with Lenz's Law, the electrically conductive particles will be subjected to respective resultant forces which tend to move them in the direction of apparent field movement at a velocity corresponding to the relative velocity of the fields. Accordingly, the resultant forces will have respective laterally directed components which will be greater than opposing component forces and will move the associated electrically conductive particles laterally out of the streams.

Also, the resultant forces will have respective longitudinal upwardly directed components which may be greater, equal to, or less than opposing longitudinal directed components of the force of gravity acting on the electrically conductive particles, depending on the rotational velocity of the moving magnetic fields. If the longitudinal upwardly directed components of the resultant forces are greater in magnitude than the opposing longitudinal components of the force of gravity, the electrically conductive particles may spiral upwardly of the frusto-conical member 38*a* in the direction of apparent magnetic field movement. Preferably, the magnets 36 of array 34 are rotated at a velocity such that the longitudinal components of the resultant forces are smaller in magnitude than the opposing components of the gravity. As a result, the electrically conductive particles will diverge angularly from the streams, while travelling longitudinally down the sloped outer surface of member 38*a*.

Thus, the electrically conductive particles undergo additional lateral deflection, due to the rotation of array 34, and in substantially the same direction as the lateral deflection due to the magnets 36 being disposed transversely at an oblique angle to the streams. Accordingly, the lateral deflecting force exerted on an electrically conductive particle due to the clockwise rotation of array 34 is added to the lateral deflecting force exerted on the electrically conductive particle due to the relative orientation of the magnets 36 in array 34 to provide a greater lateral separation of the particle from the respective stream. Consequently, the factor that may limit the rotational velocity of the magnets 36 in array 34 may be the desired lateral deflections of the electrically conductive particles.

During rotation of array 34, the lateral deflecting force exerted on an electrically conductive particle still is dependent on the induced eddy-currents which periodically attain maximum values when the particle passes through regions of maximum flux change in array 40. Since these regions of maximum flux change occur in array 40 over interfacing surfaces of adjacent magnets 36 in array 34, the electrically conductive particles undergoing maximal lateral deflection are the particles having optimal sizes approximating the width dimensions of the magnets 36. Accordingly, maximum lateral deflection is achieved by electrically conductive particles of relatively small size on the upper end portion of separator 22*a*, of average size on the midportion of separator 22*a*, and of relatively large size on the lower end portion of separator 22*a*. However, since the number of regions of maximum flux change passed through by an electrically conductive particle is dependent on the rotational velocity of the array 24, lateral deflection of electrically conductive particles and the resulting separation from their respective streams may be adjusted by varying the rotational velocity of array 34.

The motor 74 may be of the reversible type whereby the array 34 may be rotated in the counterclockwise direction, as viewed in FIG. 2, when desired. Thus, to an electrically conductive particle in a stream directed longitudinally down the sloped surface of member 38*a*, the resulting magnetic field movement of array 40 would appear to be downwardly and counter-clockwise, as viewed in FIG. 3. Consequently, the electrically conductive particle would be subjected to a force which, in accordance with Lenz's Law, would be in the direction of apparent field movement. Accordingly, this force may be resolved into two components, one an accelerating component directed longitudinally down the sloped surface of member 38*a* and other a laterally deflecting component directed to the right of the streams.

The accelerating component of the force derived from the counterclockwise rotational direction of array 34 is in opposition to the decelerating component of the force due to the magnets 36 being disposed transversely at an oblique angle to the stream. Consequently, the accelerating component aids the force of gravity acting on the electrically conductive particle in overcoming the decelerating component and moving the particle longitudinally down the sloped surface of member 38*a*. Similarly, the deflecting component of the force derived from the counter-clockwise rotational direction of array 34 is in opposition to the deflecting component of the force due to the magnets 36 being disposed transversely at an oblique angle to the stream. Thus, the rotational velocity of array 34 in the counterclockwise direction may be increased to a value where the magnitude of associated laterally deflecting component may be greater than the magnitude of the opposing laterally deflecting force due to the orientation of the magnets 36 with respect to the stream. As a result, electrically conductive particles will be deflected laterally out of the right-hand sides of the respective streams instead of the left-hand side thereof, as viewed in FIGS. 1 and 2, while sliding down the sloped surface of member 38*a*.

Figure 7:
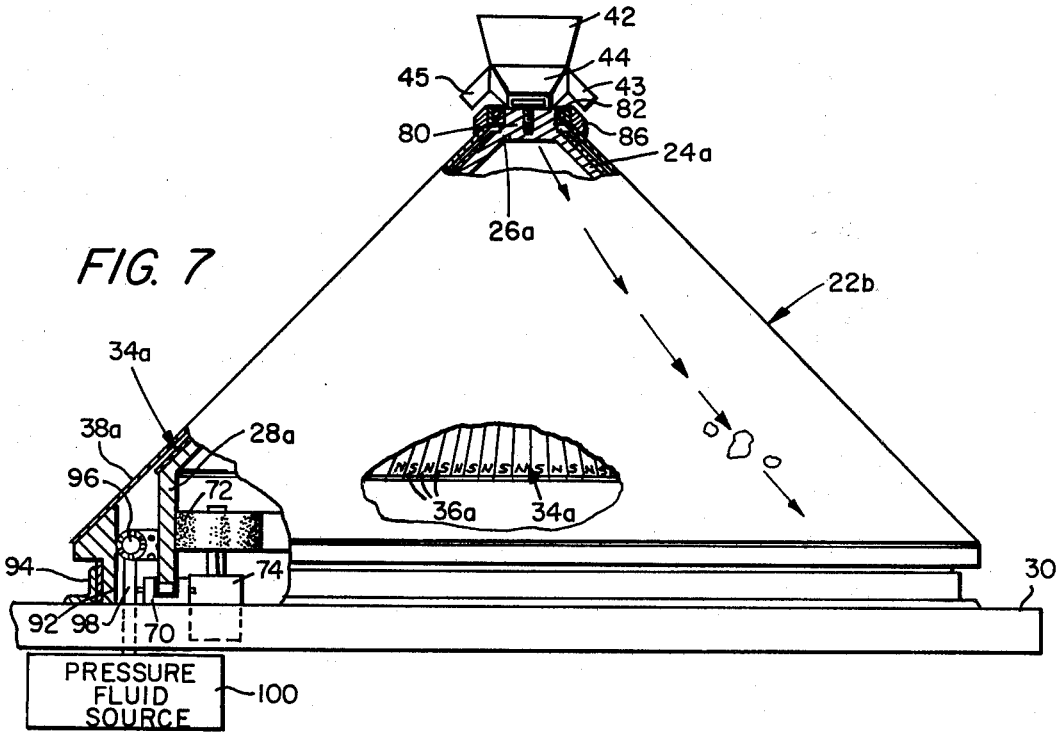
FIG. 7 is an elevational view, partly in section, of another alternative embodiment of the invention.
Figure 8:
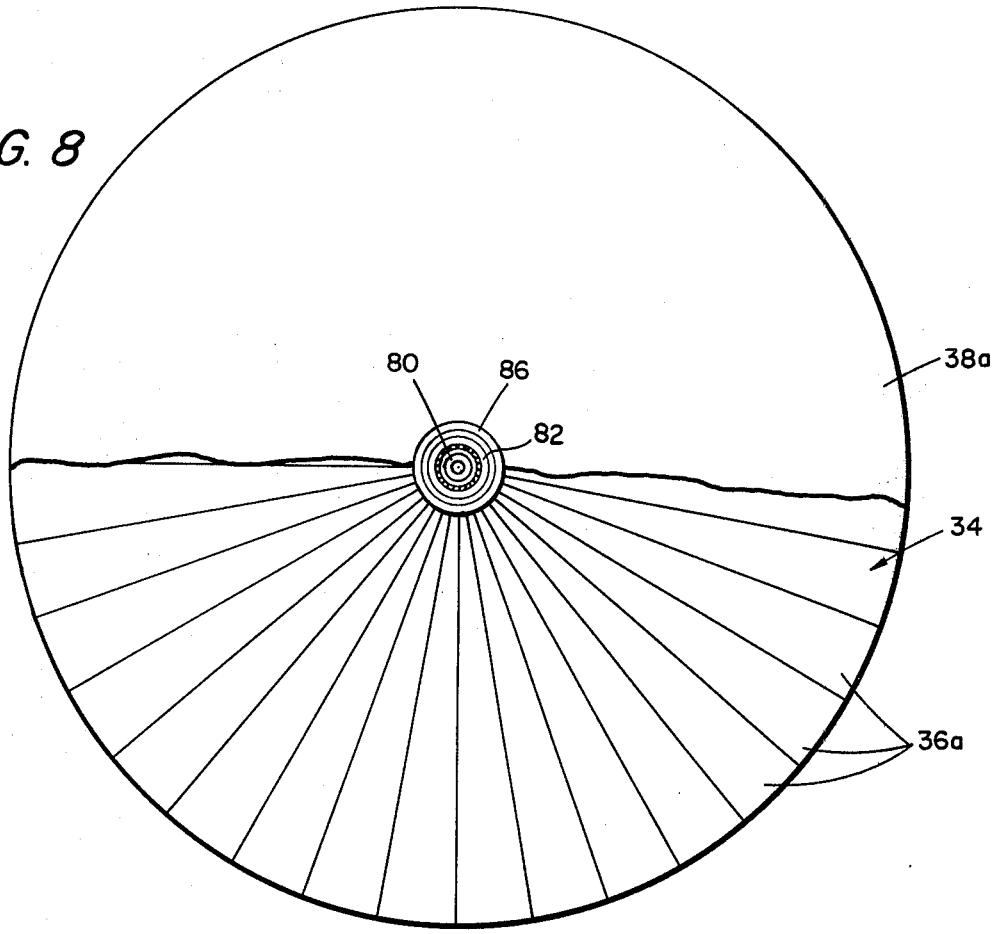
FIG. 8 is a plan view, partly in section, of material separator shown in FIG. 7.
Figure 9:
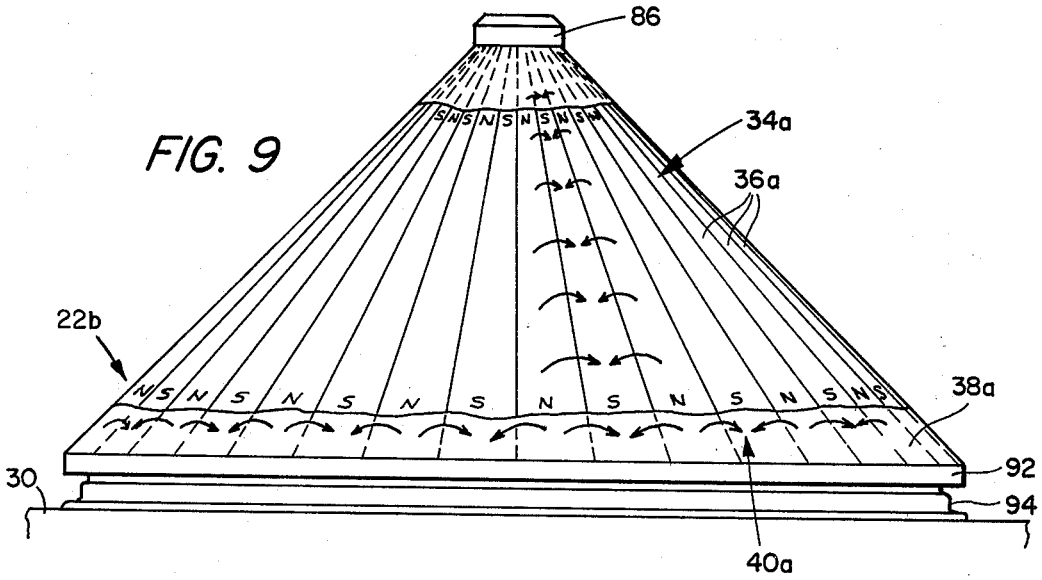
FIG. 9 is an elevational view of the inner frusto-conical member shown in FIG. 8.

In a second alternative embodiment, as shown in FIGS. 7–9, the materials separator apparatus 20 may include a materials separator 22*b*. The materials separator 22*b* is similar in structure to materials separator 22*a*, except the rotatable support member 24*a* carries a frusto-conical array 34*a* of juxtaposed, steady-state magnets 36*a* having respective wedge-shaped configurations. Thus, the magnets 36*a* have respective uniformly tapering widths laid side-by-side about the sloped portion of support member 34*a*, and extended longitudinally along the sloped height thereof. Accordingly, magnets 36*a* have respective maximum width end portions disposed annularly in juxtaposed relationship adjacent the skirt 28*a* which has an inner surface frictionally engaged by the drive roller 76 rotatable coupled to motor 78, and by the idler rollers 80, as shown in FIGS. 4 and 6. Also, the magnets 36*a* have respective minimum width end portions disposed annularly in juxtaposed relationship adjacent the roller bearing 84 connected through apertured flange 88 to the outer frusto-conical member 38*a*. The member 38*a* is made of smooth-surfaced, nonmagnetic material and is spaced from the array 36*a* by an interposed thin film of air egressing from distributor pipe 96 connected through conduit 98 to the pressurized source 100.

The magnets 36*a* preferably are disposed in substantially contiguous relationship with one another, and may be cut or stamped from the aforementioned magnet strip material. Adjacent magnets 36*a* of the array 34*a* are oppositely magnetized through their respective thicknesses to provide adjacent opposing surfaces of the array with respective alternating series of north and south magnetic poles. Each pole of the alternating series adjacent the outer member 38*a* is magnetically coupled to adjacent magnetic poles on either side thereof by respective oppositely directed fields of magnetic flux extended arcuately above the sloped outer surface of the member 38*a*. Thus, there is established above the member 38*a* a steady-state array 40*a* of spatially alternating, oppositely directed magnetic fields having respective uniformly varying widths which taper from maximum values adjacent the larger diameter end portion of member 24*a* to minimum values adjacent the smaller diameter end portion thereof.

In operation, the source 100 may be activated to provide the thin film of air between array 34*a* and the outer member 38*a*. Also, the motor 74 may be energized to rotate the inner support member 24*a* and the array 34*a* of magnets 36*a* in a particular rotational direction, such as clockwise as viewed in FIG. 8, for example. A material feeder means, such as hopper 42, for example, may be supported over the upper end portion of separator 22*a*, and be provided with a plurality of angularly spaced, output chutes for directing respective streams of commingled, nonferromagnetic particles down aligned sloped portions of outer member 38*a*. As a result, the rotating fields of array 40*a* established above the outer sloped surface of member 38*a* sweep angularly past the commingled particles in the streams. Dielectric particles, such as 52 shown in FIGS. 1 and 2, for example, are unaffected by the rotating fields, and continue to travel down aligned portions of the member 38*a* to deposit in a suitably placed container.

However, the electrically conductive particles in the streams are subjected to respective forces which, in accordance with Lenz's Law, tend to move them in the direction of apparent field movement. As a result, the electrically conductive particles are deflected to the left, as viewed in FIG. 9, for a clockwise rotation of array 34*a* of magnets 36*a*. Conversely, since motor 74 is reversible, the array 34*a* of magnets 36*a* may be rotated in the counterclockwise direction, as viewed in FIG. 8, and result in a lateral deflection of electrically conductive particles to the right, as viewed in FIG. 9. In either instance, the electrically conductive particles separate angularly out of the respective streams while sliding down the sloped surface of member 38*a*. On the other hand, the lateral deflection of electrically conductive particles by rotation of the wedge-shaped magnets 36*a* takes place without the decelerating or accelerating components of force produced by the magnets 36 being transversely disposed at oblique angles to the streams.

As in the previous embodiment, the lateral deflecting forces exerted on electrically conductive particles are dependent on the magnitudes of respective eddy-currents induced in the particles by the rotating magnetic fields. As a result, the lateral deflecting forces are maximal when peak eddy-currents are induced periodically in the electrically conductive particles by regions of maximum flux change over interfacing surfaces of adjacent magnets 26*a* sweeping past the particles. Accordingly, electrically conductive particles of relatively small sizes approximating the minimum width dimensions of wedge-shaped magnets 36*a* undergo maximal lateral deflections on the small diameter, upper end portion of separator 22*a*. Similarly, electrically conductive particles of average size undergo maximal lateral deflections on the mid-portion of separator 22*a*; and electrically conductive particles of relatively large sizes undergo maximal lateral deflections on the large diameter, lower end portion of separator 22*a*. Consequently, containers may be positioned adjacent skirt 28*a* and in alignment with the paths of the deflected particles to receive therein the respective particles. Lateral deflection of the electrically conductive particles out of the respective streams may be adjusted by varying the rotational velocity of the array 34*a* of magnets 36*a*, since lateral deflection is dependent on the number of maximum flux changes in array 40*a* sweeping past the electrically conductive particles in a given time interval.

Figure 10:
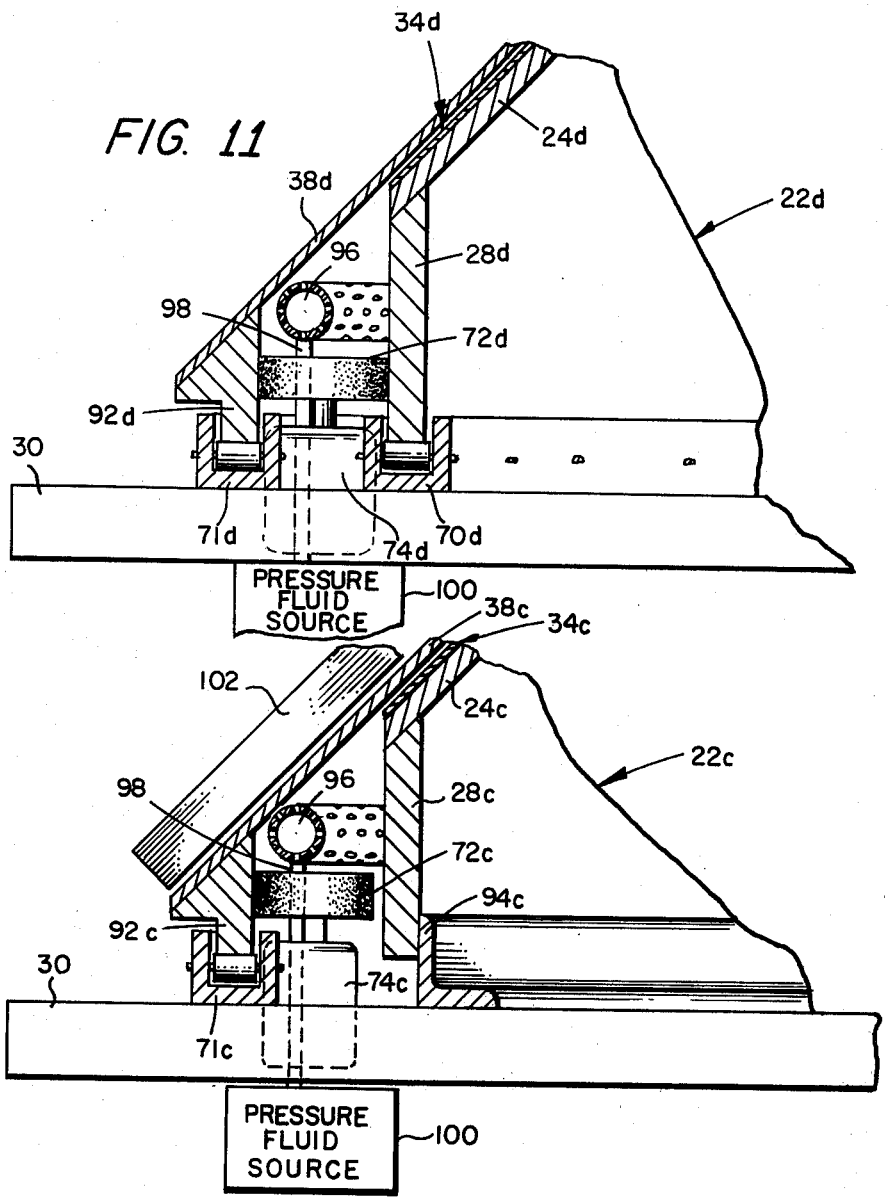
FIG. 10 is a fragmentary axial view illustrating an alternative rotation means for the embodiments shown in FIGS. 4 and 7.

FIG. 10 shows a third alternative embodiment including a materials separator 22*c* having a stationary inner support member 24*c* and a rotatable outer member 38*c*. The respective members 24*c* and 38*c* are similar in structure to the corresponding members 24*a* and 38*a* shown in FIGS. 4–5 having their small diameter end portions rotatably connected to one another through an interposed roller bearing 84. However, in this instance, the frusto-conical inner member 24*c* has a large diameter end portion terminating in an annular skirt 28*c* which is secured by means of an interconnecting annular bracket 93*c* to the stationary platform 30. Disposed on the outer sloped surface of support member 24*c* is a frusto-conical array 34*c* of juxtaposed, steady-state magnets which may be of the spiralling type 36 shown in FIGS. 1–3 or of the wedge type 36*a* shown in FIGS. 7–9.

The frusto-conical outer member 38*c* has a large diameter end portion terminating an axially extending, annular wall 92*c* which has a circular rim rotatably mounted in a sealed bearing 71*c* similar to the bearing 70 shown in FIG. 4. Frictionally engaging the inner surface of annular wall 93*c* is a drive roller 72*c* and preferably a circular array (not shown) of counter-balancing idle rollers, such as shown in FIG. 6, for example. The drive roller 72*c* is rotated by suitable means, such as a drive motor 74*c* supported on platform 30, for example. Also, the inner sloped surface of member 38*c* is spaced from the outer sloped surface of array 34*c* by an interposed thin film of air egressing from distributor pipe 96 which is connected through a suitable conduit 98 to a source 100 of pressurized fluid, such as air, for example. Since the outer member 38*c* is rotatable, a linear portion of its sloped surface may be contactingly engaged by a longitudinal edge of a wiper means 102 for the purpose of removing magnetic particles clinging to the surface.

In operation, the motor 74*c* may be energized to rotate the outer member 38*c* in a particular rotational direction, such as counterclockwise, for example, after the source 100 has been activated to provide a thin film of air between outer member 38*c* and the array 34*c* of magnets. Consequently, to an electrically conductive particle on the sloped outer surface of member 36*c*, the magnetic fields established above the surface by the array 34*c* appear to be moving in the opposite rotational direction. Accordingly, if the array 34*c* is comprised of juxtaposed wedge-shaped magnets, as shown in FIGS. 7–9, for example, the magnetic fields established by the array 34*c* appear to be moving in the clockwise direction. On the other hand, if the array 34*c* is comprised of juxtaposed spiralling magnets, as shown in FIGS. 1–3, for example, the magnetic fields established by the array 34*c* appear to be spiralling upward to the left, as viewed in FIG. 3. In accordance with Lenz's Law, the electrically conductive particles on the sloped outer surface of member 38*c* will be subjected to respective forces, which will tend to move these particles in the apparent direction of magnetic field movement, as previously, described. As a result, the electrically conductive particles will separate angularly from a stream of commingled particles sliding down the sloped outer surface of member 38*c*, as shown in FIGS. 1–2, for example.

Thus, the embodiment shown in FIG. 10 operates magnetically in a fashion similar to the embodiments shown in FIGS. 4–9. However, when the outer member 38*c* is rotated in the counterclockwise direction, commingled particles in streams on the outer sloped surface of member 38*c*, are carried in the counterclockwise direction also. On the other hand, the electrically conductive particles are deflected from the streams in the clockwise direction of apparent field movement. As a result, there is a wider spread of separation between dielectric particles, such as 52 shown in FIG. 2, for example, which are carried in the counterclockwise direction by the outer member 38*c*, and electrically conductive particles, such as 56, 60, and 64, for examples, which are deflected in the opposite direction. Consequently, in this embodiment, it may be required that only two streams of commingled particles be directed down respective longitudinal halves of the outer member 38*c*. The separation spread between dielectric particles and electrically conductive particles in a stream may be decreased by rotating the outer member 38*c* at an equivalent velocity in the opposing or clockwise direction.

Conversely, the separation spread between dielectric particles and electrically conductive particles may be increased by increasing the rotational velocity of the outer member 38*c*. Thus, the dielectric particles in the streams may be carried still further in the counterclockwise direction, for example; and the electrically conductive particles will be deflected still further in the clockwise direction by the apparent greater velocity of the magnetic fields moving in that direction. However, if the velocity of the outer member 38*c* is increased beyond a critical value, centrifugal force may lift the particles on the outer surface of member 38*c* out of the magnetic fields. This problem may be overcome by maintaining the velocity of the outer member 38*c* below the critical value and simultaneously rotating the inner support member in the opposing rotational direction.

As shown in FIG. 11, another alternative embodiment may include a materials separator 22*d* which is similar to the material separator 22*c*, except the inner support member 24*d* and the outer member 38*d* are rotatable in opposing directions. Thus, inner support member 24*d* may terminate at its larger diameter end portion in an annular skirt 28*d* having a circular rim rotatably mounted in a circular sealed bearing 70*d*.

Disposed on the sloped outer surface of member 24d is a frusto-conical array 34d of juxtaposed, steady-state magnets which may be of the spiralling type 36 shown in FIGS. 1–3 or of the wedge type 36a shown in FIGS. 7–9. The respective members 24d and 38d may have smaller diameter end portions rotatably connected to one another by an interposed roller bearing, such as 82 shown in FIGS. 4–5, for example.

Outer member 38d may terminate at its larger diameter end portion in an annular wall 92d having a circular rim mounted in a circular sealed bearing 71d. The wall 92d has an inner surface frictionally engaged by a drive roller 72d, which has an opposing peripheral portion frictionally engaging an outer surface portion of annular skirt 28d. Roller 72d may be rotatably connected to a drive motor 74d which is supported on the stationary platform 30. The inner surface of member 38d may be suitably spaced from the array 34d of magnets on the outer sloped surface of member 24d by an interposed thin film of air. Disposed between the annular wall 92d and the skirt 28d may be a distributor pipe 96 which is connected through a conduit 98 to a pressurized source 100 of air supported on platform 30.

In operation, the source 100 is activated to send pressurized air through distributor pipe 96 to provide the thin film of air between outer member 38d and the array 34d of magnets. The motor 74d is energized to rotate roller 72d, thereby rotating the frictionally engaged members 24d and 38d in opposing rotational directions, such as clockwise and counterclockwise, respectively, for example. Rotation of member 38d carries commingled particles on its sloped outer surface in the corresponding or counterclockwise direction, which produces an apparent movement of the fields established by array 34d in the opposite or clockwise direction, as in the embodiment shown in FIG. 10. This apparent movement of the fields is increased by actual clockwise movement thereof due to the corresponding rotation of inner member 24d and array 34d. Thus, the separation effect achieved with the embodiments shown in FIGS. 4–6 or FIGS. 7–9 is increased by separation effect achieved with the embodiment shown in FIG. 10. This combined separation action may be increased or decreased by varying the rotational velocities of the respective members 24d and 38d accordingly. However, increasing the rotational velocity of the outer member 38d above a critical value may cause commingled particles on the outer surface thereof to be lifted by centrifugal forces out of the fields established by array 34d. Therefore, the outer member 38d ideally is maintained at a rotational velocity sufficient to minimize frictional resistance to the particles sliding down the sloped outer surface of member 38a, while retaining the particles in the fields established by array 34d. Any further increases desired in the separation action of the embodiment shown in FIG. 11 may be achieved by increasing the rotational velocity of inner member 24d and array 34d.

FIGS. 12–14 show an alternative embodiment comprising materials separator apparatus 110 which is similar to apparatus shown in referenced U.S. Pat. No. 4,003,830, but includes varying width magnetic means for separating an extremely wide range of electrically conductive particles sizes from a stream of commingled materials. Thus, apparatus 110 may include material feeder means comprising a funnel-shaped hopper 112 disposed for receiving therein commingled particles 114 of waste materials and directing them into an egressing stream which is fed onto an endless belt 116. The belt 116 is movably supported by spaced rollers, 118 and 120, respectively, for conveying the stream longitudinally toward the roller 120. Roller 120 may comprise a magnetic separator means of the conventional drum-type having magnet pole pieces in its outer peripheral surface for attracting ferromagnetic or highly magnetic materials in the stream. Consequently, when the belt 116 carries the stream around roller 120, particles 114a of ferromagnetic material, such as mild steel, for example, cling to the belt due to the magnetic attraction of roller 120. The particles 114a continue to travel with the belt 116 until the force of gravity overcomes the magnetic attractive force of roller 120, and causes the particles 114a to drop into a suitably positioned container 122.

On the other hand, particles 114b of nonferromagnetic material remaining in the stream drop from belt 116 passing around roller 120, and into an upper end portion of a chute 124 which comprises guide means for directing the stream along a predetermined path. The lower end portion of chute 124 is positioned over and adjacent a longitudinal side of a ramp-type structure 126. Structure 126 may include control means comprising an inclined support panel 128 made of rigid nonmagnetic material, such as wood, for example, and having a lower end portion pivotally attached by means of a pintle 130 to a base support frame 132. The support panel 128 may be rotated about pintle 130 by convenient control means, such as a rope 134 having an end portion attached to the upper end portion of structure 126 and passed through an overhanging pulley 136, for example. Thus, the rope 134 and pulley 136 provide means for positioning the panel 128 at any desired angle of inclination with respect to the vertical.

Disposed in the upper surface of panel 128 is a recess 138 having any desired configuration, such as a parallelogram with transverse ends extended at substantially uniform oblique angles with respect to the longitudinal centerline of panel 128, for example. The bottom surface of recess 138 preferably is lined with a sheet 140 of low magnetic reluctance material, such as mild steel, for example. Overlying the sheet 140 is a magnetic means comprising an alternating array 142 of juxtaposed, oppositely polarized magnets 144 which extend transversely at an oblique angle, such as forty-five degrees, for example, to the longitudinal centerline of panel 128. Unlike the magnets of the previous embodiments, however, the magnets 144 may have respective widths which are uniform from end-to-end of the magnets but which vary from magnet-to-magnet in the array 142. Preferably, the respective widths of the magnets 144 increase uniformly from a minimum width in the upper end portion of array 142 adjacent chute 124 to an average width in the midportion of array 142 to a maximum width in the lower end portion thereof. Thus, in accordance with this invention, the magnets 144 of array 142 have varying widths which preferably are minimum in the upper end portion of the array and a maximum in the lower end portion thereof.

The array 142 may comprise a plurality of permanent bar-type magnets 144 laid side-by-side in contiguous relationship to fill the recess 138. Magnets 144 are magnetized through their respective thicknesses to provide at the upper and lower surfaces of array 142 respective alternating series of north and south magnetic poles. Each magnetic pole in the series established at the lower surface of array 142 is magnetically coupled to adjacent magnetic poles on either side thereof by respective oppositely directed, magnetic fields of flux extended through the low reluctance material of sheet 140. Also, each magnetic pole in the series established at the upper surface of array 142 is magnetically coupled to adjacent magnetic poles on either side thereof by respective oppositely directed, magnetic fields of flux extended arcuately above the upper surface of array 142.

The magnets 144 preferably have respective thicknesses substantially equal to the depth of recess 138 whereby the upper surfaces of magnets 144 may be substantially flush with the upper surface of panel 128. Overlying the respective upper surfaces of array 142 and panel 128 is a control means comprising a smooth-surfaced layer 146 of nonmagnetic material, such as austenitic steel, for example. The layer 146 is disposed between longitudinal guide members 148 and 149, respectively, made of nonmagnetic material, such as wood, for example. Surface layer 146 and respective guide members 148–149 are fastened to underlying portions of panel 128 by conventional means, such as countersunk screws (not shown) of nonmagnetic material, for example. Thus, there is established above the upper surface of layer 146 a spatially alternating, steady-state array 150 of juxtaposed, oppositely directed magnetic fields which extend transversely at an oblique angle to the stream of particles **114*b* egressing from the lower end portion of chute 124. The magnetic fields of array 150 vary in width, being minimum in the upper end portion of array 150, average in the midportion of array 150, and maximum in the lower end portion of array 150. Also, the support panel 128 and surface layer 146 constitute an inclined plane 152 disposed over array 150 and having a low friction surface down which nonferromagnetic particles 114*b* in a stream egressing from chute 124** may slide by gravitational means.

In operation, as taught in the referenced U.S. Pat. No. 4,003,830, the particles **114*b* sliding down the inclined plane 152 pass sequentially through the spatially alternating fields of steady-state array 150. The dielectric particles of nonferromagnetic material are unaffected by the fields, and continue to follow generally linear paths down the inclined plane 152 to drop into a suitably positioned container 154. On the other hand, the electrically conductive particles of nonferromagnetic material have induced therein respective eddy-currents which coact with the magnetic fields of array 150 to exert on these particles respective resultant forces. The resultant forces are uniformly directed upwardly along the inclined plane 152 and perpendicular to the magnets 144 of array 142. Consequently, each of the resultant forces may be resolved into two components, one a decelerating component directed longitudinally upward of the inclined plane 152 and the other a laterally deflected component directed to the right as viewed in FIG. 13. The decelerating components of the resultant forces usually are insignificant in comparison with the opposing accelerating components of the force of gravity due to the inclination of plane 152 with respect to the vertical. However, the laterally deflecting components of the resulting forces are not similarly opposed by respective force components of greater magnitude and, consequently, cause the electrically conductive particles to move laterally while continuing to travel longitudinally of the inclined plane 152. Thus, the electrically conductive particles separate angularly from the stream of commingled particles sliding down the longitudinal portions of inclined plane 152 aligned with the chute 124**.

However, the electrically conductive particles sliding down the inclined plane 152 pass through periodic maximal flux changes occurring in array 150 over interfacing surfaces of magnets 144 and inducing peak eddy-currents. Consequently, relatively small, electrically conductive particles have optimal sizes for undergoing maximal lateral deflections on the upper end of inclined plane 152 overlying the minimum width magnets 144 of array 142. When these relatively small, electrically conductive particles are deflected along paths deviating angularly from the stream of commingled particles, they continue to travel along the angularly deviating paths to the lower end of inclined plane 152 and deposit in a suitably positioned container 155. Similarly, electrically conductive particles of relatively average sizes undergo maximal lateral deflection on the midportion of inclined plane 152 to travel along angularly deviating paths and deposit in a suitably positioned container 156 at the lower end of inclined plane 152. Also, relatively large, electrically conductive particles undergo maximal lateral deflections on the lower end portion of inclined plane 152 to travel along angularly deviating paths and deposit in a suitably positioned container 157 at the lower end of inclined plane 152.

Figure 15:
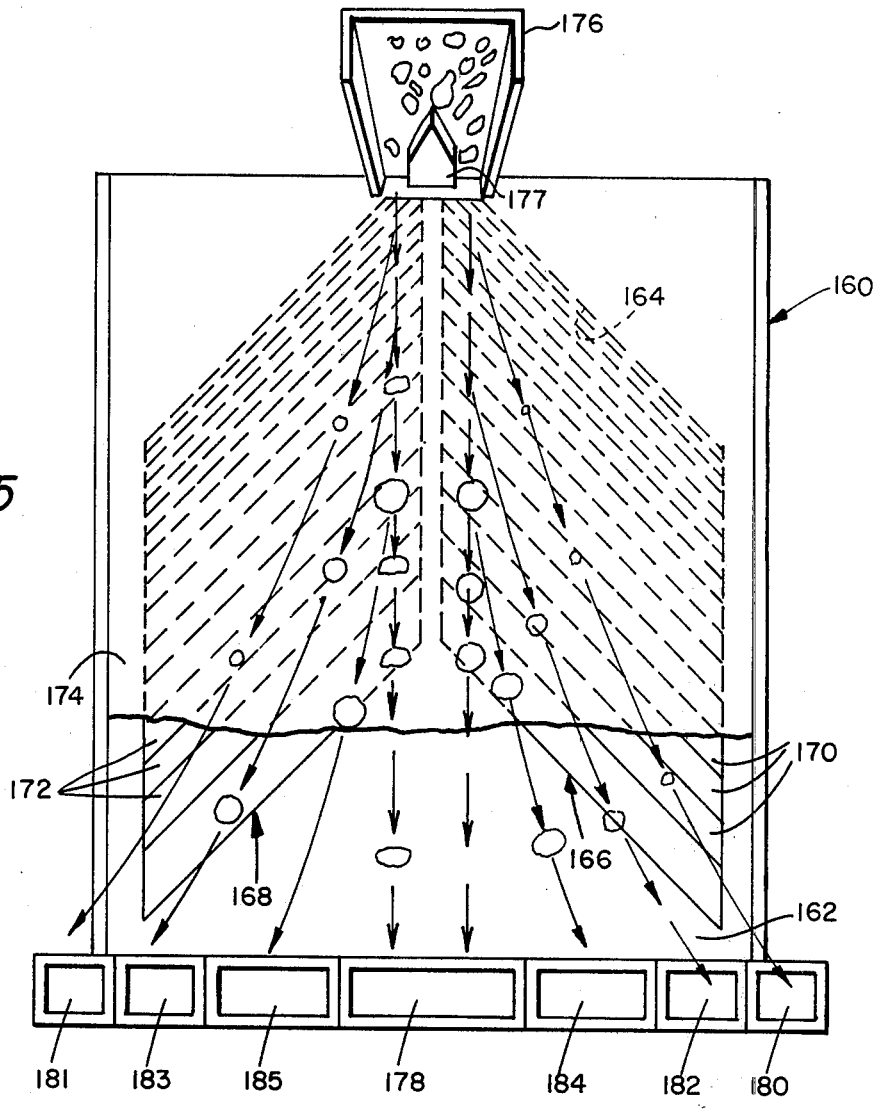
FIG. 15 is a view of an alternative materials separator for use in the apparatus shown in FIG. 12.

Alternatively, as shown in FIG. 15, the apparatus 110 may be provided with a dual ramp-type structure 160 having one longitudinal half similar to the ramp-type structure 126 and the other longitudinal half comprising a mirror image thereof. Thus, the structure 160 may include an inclined support panel 162 similar to the support panel 128 but having in its upper surface a chevron-shaped recess 164. Disposed in each longitudinal half of recess 164 is a respective alternating array 166 and 168 of juxtaposed, oppositely polarized magnets, 170 and 172, respectively, which extend transversely at an oblique angle to the longitudinal centerline of panel 162. The respective arrays 166 and 168 are similar to the array 142, but have corresponding magnets, 170 and 172, respectively, disposed in reverse angulated relationship along the longitudinal centerline of panel 162. Accordingly, the magnets 170 and 172 have respective widths which are uniform from end-to-end of the magnets, but which vary from magnet-to-magnet of the arrays, 166 and 168, respectively. Thus, the respective widths of the magnets 170 and 172 may increase uniformly from a minimum width in the upper end portions of arrays 166 and 168, respectively, to a maximum width in the lower end portions thereof.

Overlying, the upper surface of panel 162 and the respective upper surfaces of arrays 166 and 168 is a smooth-surfaced layer 174 of nonmagnetic material, which is similar to the layer 146. Consequently, above the layer 174, each of the arrays 166 and 168 establishes a respective spatially alternating, steady-state array of juxtaposed, oppositely directed magnetic fields which, in combination, form a herringbone pattern along the longitudinal centerline of panel 162. The magnetic fields of each array vary in width, being minimum in the upper end portion of the array, average in the midportion thereof, and maximum in the lower end portion of the array. One array of magnetic fields is similar in orientation to the magnetic fields of array 150 and functions in a similar manner, that is deflecting electrically conductive particles laterally to the right as viewed in FIG. 15. The other array of magnetic fields is oriented in the reverse angular direction as compared to the array 150 and functions to deflect electrically conductive particles laterally in the opposite direction, that is to the left as viewed in FIG. 15.

Consequently, a chute 176 may have an output portion positioned centrally over the upper end of ramp-type structure 160, and provided with a stream splitter device 177, for directing respective streams of commingled particles down aligned longitudinal portions of the surface layer 174. Dielectric particles in the respective streams sliding down layer 174 are unaffected by the magnetic fields established above it and are deposited in an aligned container 178 at the lower end of support panel 162. Relatively small electrically conductive particles undergo maximal lateral deflections on the upper end portions of respective longitudinal halves of the structure 160 and follow divergent angularly deviating paths to drop in respective containers 180 and 181. Average size, electrically conductive particles undergo maximal lateral deflections on the midportions of respective longitudinal halves of the structure 160 and follow divergent angularly deviating paths to drop into respective containers 182 and 183. Relatively large, electrically conductive particles undergo maximal lateral deflections on the lower end portions of respective longitudinal halves of ramp-structure 160 and drop into respective containers 184 and 185. Thus, the dual ramp-type structure 160 provides means for processing twice as much waste material as compared with the single ramp-type structure 126.

Figure 16:
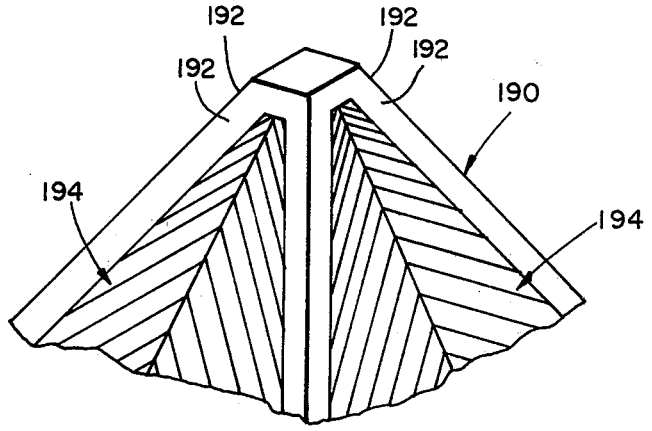
FIG. 16 is a fragmentary schematic view of another alternative materials separator for use in place of the materials separators shown in FIGS. 12 and 15.

As shown in FIG. 16, the capacity for processing waste material may be further increased by use of a frusto-pyramidal structure 190 having a plurality of sloped surfaces 192. Each of the sloped surfaces 192 may comprise a dual ramp-type structure 194 which is similar to the dual ramp-type structure 160 shown in FIG. 15 and functions in a similar manner. Supported over the upper end of frusto-pyramidal structure 190 may be suitable material feeder means (not shown), such as funnel-shaped hopper 42 having respective output chutes 43, 44, 45, and 46, as shown in FIG. 2, for example. The upper end surface of frusto-pyramidal structure 190 may be flat or rounded or have any suitable contour for directing streams of commingled particles down each of the sloped surface 192. Also, suitable conveying means (not shown), such as respective containers 178 and 180–185 shown in FIG. 15, for example, may be disposed at the lower end of each sloped surface 192 for receiving therein separated particles. Thus, the frusto-pyramidal structure 190 provides means for processing more waste material than the dual ramp-type structure shown in FIG. 15.

From the foregoing, it will be apparent that all of the objectives of this invention have been achieved by the structures shown and described herein. It also will be apparent, however, that various changes may be made by those skilled in the art, without departing from the spirit of the invention as expressed in the appended claims. It is to be understood, therefore, that all matter shown and described herein is to be interpreted as illustrative and not in any limiting sense.

What is claimed is:

1. Materials separator apparatus comprising:

material conductor means disposed for directing commingled particles including electrically conductive nonferromagnetic particles of various materials and sizes into a stream;

magnetic means including an alternating series of oppositely polarized magnetic pole pieces disposed in juxtaposed and substantially contiguous relationship for establishing a spatially alternating array of juxtaposed oppositely directed magnetic fields of varying widths and inducing in said electrically conductive nonferromagnetic particles successive eddy-currents which cooperate with said magnetic fields for deflecting said electrically conductive particles in a uniform direction out of said stream; and control means for producing relative movement of the particles sequentially through the magnetic fields.

2. Materials separator apparatus as set forth in claim 1 wherein the magnetic means comprises steady-state magnetic means for establishing a spatially alternating array of static magnetic fields.

3. Materials separator apparatus as set forth in claim 2 wherein the steady-state magnetic means comprises an alternating series of juxtaposed oppositely polarized magnets having varying width dimensions.

4. Materials separator apparatus as set forth in claim 3 wherein the array is substantially conical and the magnets have respective scythe-like widths disposed in juxtaposed spiralling relationship adjacent the slope of the conical array.

5. Materials separator apparatus as set forth in claim 3 wherein the array is substantially conical and the magnets have respective wedge-like widths disposed in juxtaposed longitudinal relationship adjacent the slope of the conical array.

6. Materials separator apparatus as set forth in claim 3 wherein the array is substantially planar and the magnets have respective box-like widths which vary with respect to one another and are disposed transversely at an oblique angle with respect to the stream.

7. Material separator apparatus comprising:

material conductor means disposed for directing commingled particles, including electrically conductive nonferromagnetic particles, of various materials and sizes into a stream and guiding the stream along a predetermined path having a downwardly inclined portion;

steady-state magnetic means including an alternating series of oppositely polarized magnetic pole pieces disposed in juxtaposed and substantially contiguous relationship adjacent the inclined portion of the path for establishing therein a spatially alternating array of juxtaposed oppositely directed magnetic fields of varying widths and for inducing in said electrically conductive nonferromagnetic particles successive eddy-currents which cooperate with said magnetic fields for deflecting said electrically conductive nonferromagnetic particles in a uniform direction out of said stream; and control means disposed adjacent the magnetic means for producing relative movement of the particles in the stream through the magnetic fields of the array.

8. Materials separator apparatus as set forth in claim 7 wherein the material conductor means includes sloped support means disposed along the inclined portion of the path for supporting the particles in the stream slidably along the inclined portion.

9. Materials separator apparatus as set forth in claim 8 wherein sloped support means comprises a substantially conical support member having a sloped surface disposed in the inclined portion of the path; and the magnetic means comprises a substantially conical series of alternately oppositely polarized magnets disposed adjacent a sloped surface of the support member.

10. Materials separator apparatus as set forth in claim 9 wherein the magnets have respective scythe-like widths disposed in spiralling juxtaposed relationship, each of the magnets having a minimum width disposed adjacent the small diameter end of the conical series and a maximum width adjacent the large diameter end of the series.

11. Material separator apparatus as set forth in claim 9 wherein the conical series of magnets is disposed beneath the outer surface of the conical support member and supported in spaced relation with the inner surface thereof.

12. Material separator apparatus as set forth in claim 11 wherein the control means includes rotatable means disposed for producing relative rotational movement of the particles in the stream through the magnetic fields.

13. Material separator apparatus as set forth in claim 12 wherein the magnets have respective wedge-shaped widths disposed longitudinally in juxtaposed relationship, each of the magnets having a minimum width disposed adjacent the small diameter end of the conical series and a maximum width adjacent the larger diameter end of the series.

14. Materials separator apparatus as set forth in claim 8 wherein the sloped support means includes at least one inclined plane extended longitudinally along the inclined portion of the path; and the adjacent magnetic means comprises a substantially parallel planar series of alternately oppositely polarized magnets having mutually different width disposed in juxtaposed relationship.

15. Materials separator apparatus as set forth in claim 14 wherein each of the magnets of the series is bar-like and has a length disposed transversely at an oblique angle to the path of the stream.

16. Materials separator apparatus as set forth in claim 15 wherein the magnetic means includes of the series of magnets extended longitudinally along the path of the stream in a herringbone pattern, corresponding magnets of the respective series being disposed in reverse angulated relationship with respect to the stream.

17. Materials separator apparatus as set forth in claim 16 wherein the sloped support means comprises a pyramidal structure having a plurality of sloped surfaces, each comprising a respective one of the inclined planes.

18. Materials separator apparatus:

a material support structure having a sloped surface;

material conductor means disposed adjacent said structure for directing commingled particles, including electrically conductive nonferromagnetic particles, of various materials and sizes into a stream and down said sloped surface;

steady-state magnetic means including an alternating series of oppositely polarized magnetic pole pieces disposed in juxtaposed and substantially contiguous relationship beneath the sloped surface for establishing above the surface a spatially alternating array of juxtaposed oppositely directed magnetic fields of various widths and inducing in said electrically conductive nonferromagnetic particles successive eddy-currents which cooperate with said magnetic fields for deflecting said electrically conductive nonferromagnetic particles in a uniform direction out of said stream; and control means disposed adjacent the support structure for causing said stream to pass sequentially through magnetic fields of the array.

19. Materials separator apparatus as set forth in claim 18 wherein the sloped surface is substantially conical.

20. Materials separator apparatus as set forth in claim 19 wherein the magnetic means comprises a substantially conical array of alternately oppositely polarized magnets having respective tapering width poles disposed in juxtaposed relationship adjacent the sloped surface of the structure.

21. Materials separator apparatus as set forth in claim 20 wherein the magnets have scythe-like poles disposed in spiralling relationship and extended transversely at an oblique angle to the slope height of the surface.

22. Materials separator apparatus as set forth in claim 19 wherein the control means includes energy means for producing relative rotational movement of the particles through the magnetic fields.

23. Materials separator apparatus as set forth in claim 22 wherein the energy means includes fluid pressure means for spacing the sloped surface of the structure from the array of magnets.

24. Materials separator apparatus as set forth in claim 23 wherein the magnets have respective wedge-shaped poles disposed longitudinally parallel with the slope height of the surface.

25. Material separator apparatus as set forth in claim 19 wherein the magnetic means comprises a substantially planar array of alternately oppositely polarized magnets having mutually different width poles disposed in juxtaposed relationship and substantially parallel with the inclined plane.

26. Material separator apparatus as set forth in claim 25 wherein the magnets are bar-like and extend transversely at a uniform oblique angle to the stream.

27. Materials separator apparatus as set forth in claim 26 wherein the planar array comprises two co-linear series of alternately oppositely polarized, bar-like magnets disposed in a herringbone pattern along the slope of the inclined plane, corresponding magnets of the respective series being disposed in reverse angulated relationship with respect to the stream.

28. Material separator apparatus as set forth in claim 18 wherein the sloped surface comprises an inclined plane.

* * * * *

UNITED STATES PATENT OFFICE

CERTIFICATE OF CORRECTION

Patent No. 4,313,543 Dated February 2, 1982

Inventor(s) Malcolm M. Paterson

It is certified that error appears in the above-identified patent and that said Letters Patent are hereby corrected as shown below:

Column 7, line 25, change "36" to --86--.

Column 12, line 2, change "36c" to --38c--.

Signed and Sealed this

Twenty-seventh Day of September 1983

[SEAL]

*Attest:*

GERALD J. MOSSINGHOFF

*Attesting Officer* *Commissioner of Patents and Trademarks*